US007314145B2

(12) United States Patent
Rodrigues et al.

(10) Patent No.: US 7,314,145 B2
(45) Date of Patent: Jan. 1, 2008

(54) RAIL FOR CHECKOUT DIVIDERS

(75) Inventors: Claudio Rodrigues, Calgary (CA); Brad Wolff, Calgary (CA); Jill Rodrigues, Calgary (CA)

(73) Assignee: Retail Media Group, Calgary (CA)

( * ) Notice: Subject to any disclaimer, the term of this patent is extended or adjusted under 35 U.S.C. 154(b) by 460 days.

(21) Appl. No.: 10/964,669

(22) Filed: Oct. 15, 2004

(65) Prior Publication Data

US 2005/0082247 A1 Apr. 21, 2005

Related U.S. Application Data

(60) Provisional application No. 60/511,675, filed on Oct. 17, 2003.

(51) Int. Cl.
*A47F 5/00* (2006.01)

(52) U.S. Cl. ..... 211/184

(58) Field of Classification Search ..... 211/184, 211/59.2, 59.3; 40/649; 186/59, 68; 312/140.1
See application file for complete search history.

(56) References Cited

U.S. PATENT DOCUMENTS 2,090,057 A 8/1937 Maddox
5,358,094 A * 10/1994 Molinaro et al. ..... 198/502.1
5,933,994 A * 8/1999 Misaresh ..... 40/649
6,148,960 A 11/2000 Fraser

* cited by examiner

*Primary Examiner*—Sarah Purol
(74) *Attorney, Agent, or Firm*—Sean W. Goodwin; Linda M. Thompson

(57) ABSTRACT

A rail slideably supports transparent checkout dividers with open bottoms in an upright position along a sidewall of a checkout conveyor. The rail has a perpendicular wall formed on a base. The base is affixed to the top of the sidewall or into a channel formed on the sidewall and the dividers are slid along the rail towards a distal end for access by the customers. A stop prevents the dividers from leaving the rail at the distal end. The perpendicular wall extends upwards into an open bottom in the checkout dividers and keeps the dividers in the upright position allowing any advertising displayed thereon to be un-obscured and oriented to be visible at all times.

27 Claims, 8 Drawing Sheets

RAIL FOR CHECKOUT DIVIDERS

CROSS REFERENCE TO RELATED APPLICATION

This application is a regular application claiming priority of U.S. Provisional Patent application Ser. No. 60/511,675, filed on Oct. 17, 2003, the entirety of which is incorporated herein by reference.

FIELD OF THE INVENTION

The present invention relates to rails for storage of dividers used at conventional checkout conveyors to separate customer orders and more particularly to rails that can be retrofit to existing checkout conveyors.

BACKGROUND OF THE INVENTION

Commonly, in retail, dividers are provided at customer checkouts to separate individual customer's purchases. Typically, the dividers are placed on a conveyor belt, between the customer's purchases to indicate to the cashier where one order ends and the next begins.

For convenience, the dividers are often stored in a channel at the edge of the conveyor or over an edge of the conveyor adjacent the cashier so that when the cashier begins to ring in the next order the divider can be placed in the channel or over the edge and slid downwards towards the next customers in line. Conventional divider bars are typically square, solid, opaque bars and often are imprinted with permanent advertisement.

U.S. Pat. No. 6,148,960 to Fraser teaches a track for use with checkout counter divider bars. The track is retrofit to existing conventional track or alternately may replace the conventional track. The track has an upright transparent slot or portion which contains advertisements visible to the customer. The track extends outwards over the conveyor to position the advertisement for viewing while allowing sufficient space behind for passage of the divider bar. The divider bar can then be slid behind the advertisement in a channel sized to carry the bar.

Use of transparent dividers, typically triangular in shape and having an open bottom, such as previously disclosed in Applicant's co-pending U.S. patent application Ser. No. 10/400,868, filed Mar. 28, 2003 and claiming priority of U.S. provisional application No. 60/367,762, filed Mar. 28, 2002, the entirety of each of which is incorporated herein by reference, necessitates a wider channel or surface upon which to store and slide the divider, while maintaining the divider in an upright orientation so that the advertising displayed on the divider is readable to the consumer. Space between the conveyor and the cash register, light standard or product racks is typically limited and therefore it is desirable to provide a surface that fits within the existing space particularly when attached as a retrofit to existing conveyors. Further, it is desirable that the surface extend only as far as necessary over the conveyor surface to maximize conveyor space and prevent dislodging the dividers from the surface due to contact with the products on the conveyor.

Clearly there is a need for a rail to support dividers having an open bottom, a wide base and carrying advertising indicia in an upright orientation without falling over for viewing the advertisements stored therein, wherein the rail fits within existing, often limited space available between the conveyor and the cash register, light standard or product racks and the like. Particularly, the rail should not obscure the advertisements carried in the divider and should not extend so far over the conveyor space that the dividers are readily dislodged by products on the conveyor. Further, the rail should provide stability for dividers to permit sliding therealong without derailing.

SUMMARY OF THE INVENTION

A rail for slideably supporting checkout dividers at a checkout conveyor. The dividers are supported in a substantially upright position on the rail and are prevented from being displaced therefrom by a longitudinal support wall which extends substantially perpendicular from a base which is affixed to a sidewall of a the checkout conveyor. A stop at a distal end of the base prevents the dividers, which can be slid axially along the base, from being displaced from the end of the rail.

In a broad aspect a rail in combination with a checkout divider comprises: a divider for separating items at a checkout comprising a longitudinal body having an open bottom and open ends; and a rail comprising a longitudinal base adapted for slideably supporting at least a portion of the checkout divider thereon and a longitudinal support wall extending substantially perpendicular from the longitudinal base and adapted for extending upwardly into the divider's open bottom for maintaining the divider in a substantially upright position thereon.

Preferably a stop is formed at a distal end of the longitudinal base for preventing dividers from sliding beyond the distal end of the rail.

In an embodiment of the invention a first portion is adapted to be affixed to a surface such as a portion of a conveyor and a second portion on the base mates thereto for affixing the rail to the surface. Preferably the second portion has downwardly depending catches which engage upwardly depending catches on the first portion which is affixed to the top of a sidewall of the conveyor, thus affixing the base to the sidewall.

Optionally the longitudinal base and the longitudinal support wall are unitary.

In another embodiment, the base has a pair of downwardly depending members which are spaced sufficient to straddle the surface, such as the conveyor sidewall and the base is typically affixed thereto using fasteners. Optionally, the downwardly depending members are offset from a center of the base for positioning the longitudinal support wall towards the conveyor to avoid interference with objects positioned adjacent the conveyor.

In another embodiment, the base has a shaped downwardly depending insert formed therealong which is adapted to be inserted into an existing channel on the top of the conveyor side wall.

DETAILED DESCRIPTION OF THE PREFERRED EMBODIMENT

Figure 1:
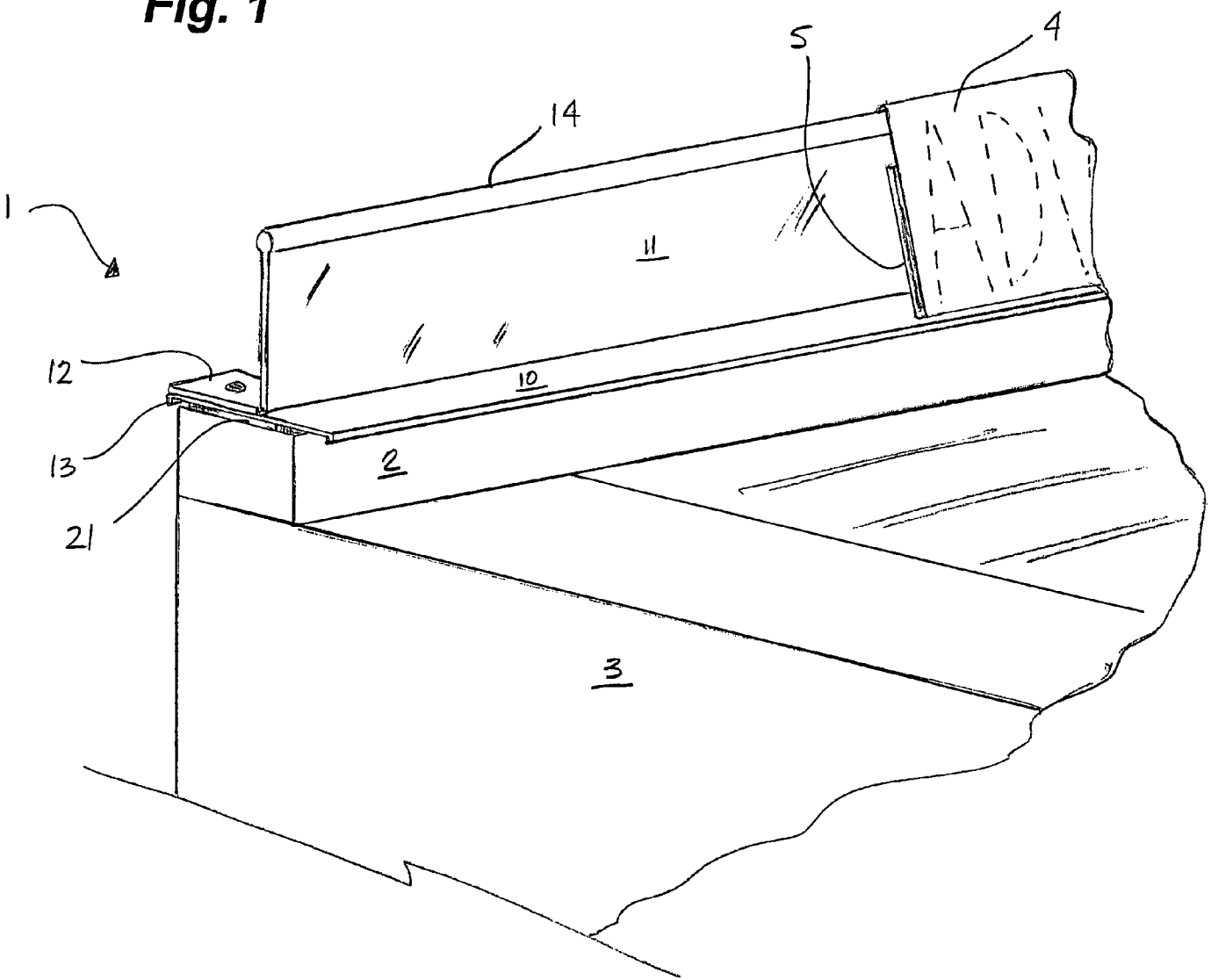
FIG. 1 is a perspective view of a checkout conveyor having a checkout divider rail according to an embodiment of the invention attached to a side wall of the conveyor, adapted for supporting a checkout divider having an open bottom.
Figure 2B:
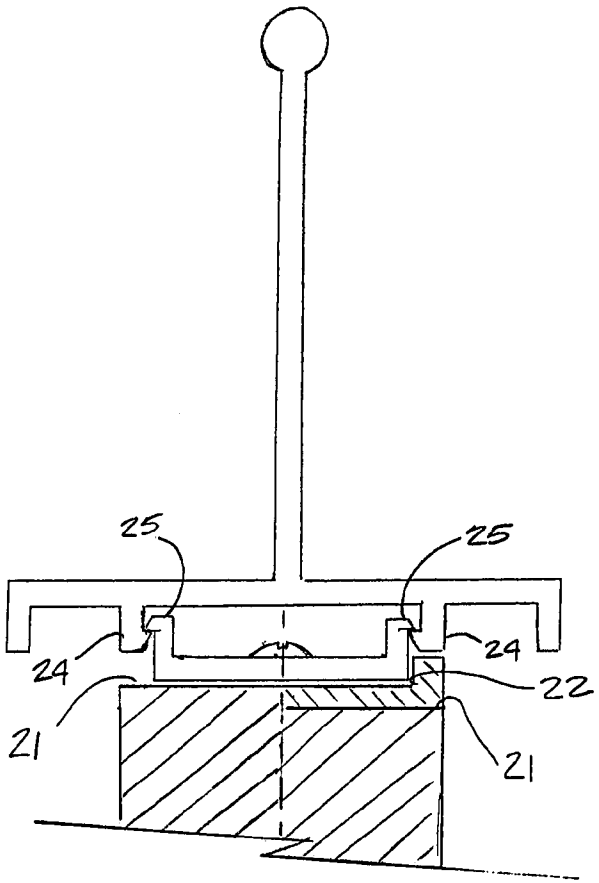
FIG. 2*b* is an end view of the checkout divider rail according to FIG. 2*a*, the first and second portions being connected for forming the rail.
Figure 2A:
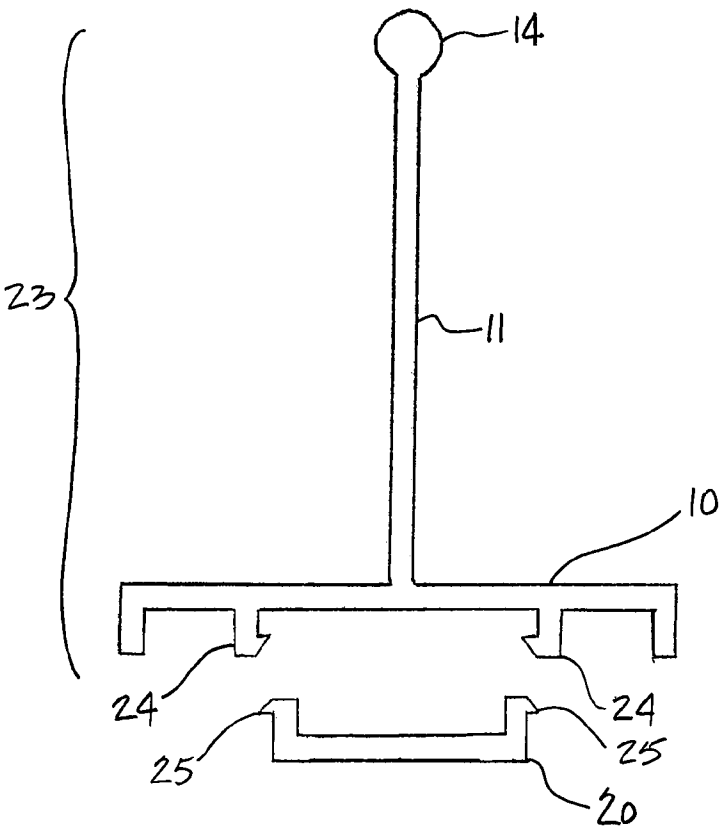
FIG. 2*a* is an end view of one embodiment of the checkout divider rail according to FIG. 1, illustrating a first attachment portion and a second supporting portion.

Having reference to FIG. 1, a checkout divider rail 1 is adapted for mounting to a side wall 2 of a checkout conveyor 3 for supporting a checkout divider 4, having an open bottom 5. The checkout divider rail 1 comprises a longitudinal base 10 and a longitudinal support wall 11, extending upwards, substantially perpendicular to the base 10. The support wall 11 extends upwards into the open bottom 5 of the checkout divider 4 for supporting the divider 4 on the base 10 in an upright orientation and preventing the divider 4 from being dislodged therefrom. Thus, the rail does not obscure the divider such as in cases where the divider has advertising indicia thereon.

Preferably, a stop 12 is affixed adjacent a distal end 13 of the rail 1 for preventing the divider 4 from sliding beyond the end 13 of the rail 1.

More preferably, an upper edge 14 of the longitudinal support wall 11 is thickened to provide additional support for the divider 4 to prevent lateral movement of the divider 4 from the rail 1.

In another embodiment of the invention, as shown in FIGS. 2*a*-2*b*, 3-5, the rail 1 comprises a first mating portion 20 affixed to a surface, such as either a top 21 of the conveyor's side wall 2 or within an existing channel 22 attached to the top 21 of the side wall 2. A second mating portion 23 comprises the base 10 and longitudinal support wall 11. First and second mating portions 20, 23 affix one to the other. More particularly, in an embodiment of the invention, the second portion 23 has downwardly depending catches 24 which mate with corresponding upwardly extending catches 25 on the first portion 20.

Figure 3:
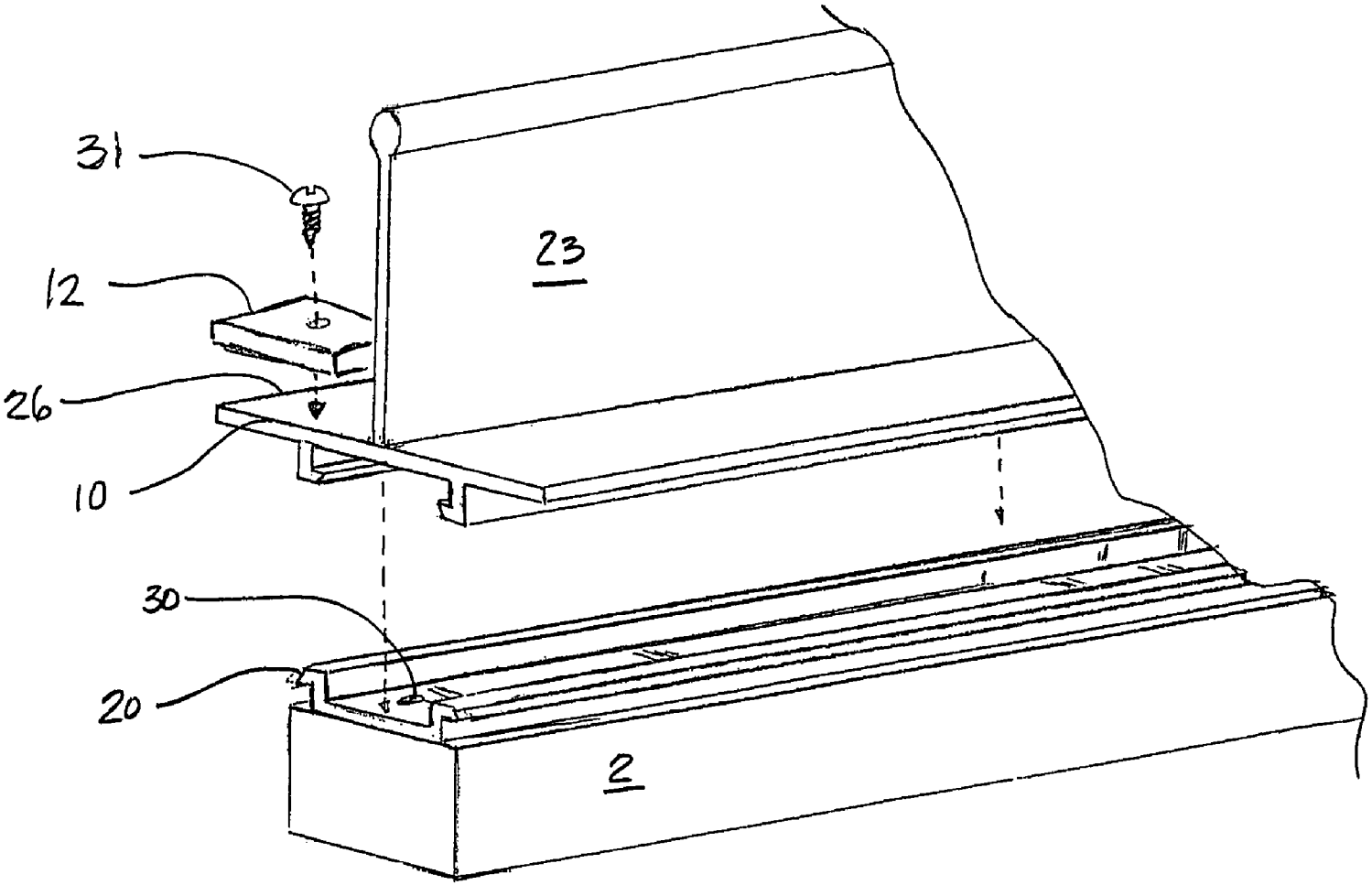
FIG. 3 is an exploded perspective view of the checkout divider rail according to FIGS. 2*a* and 2*b*, illustrating the attachment of the first portion to the conveyor side wall and the addition of a stop.

Having reference to FIG. 3, the first mating portion 20 is fastened, typically using screws 30, to the top 21 of the side wall 2 of the conveyor 3, or alternately within the existing channel 22 on the top 21 of the side wall 2. The second mating portion 23 is snapped onto the first mating portion 20 so as to cause corresponding catches 24, 25 to mate, affixing the second mating portion 23 to the first mating portion 20. The stop 12 is then fastened to the base 10 of the second mating portion 23, preferably at a side 26 opposite the conveyor 3. The stop 12 is typically fastened onto the base 10 using fastening means, such as a screw 31

Figure 4:
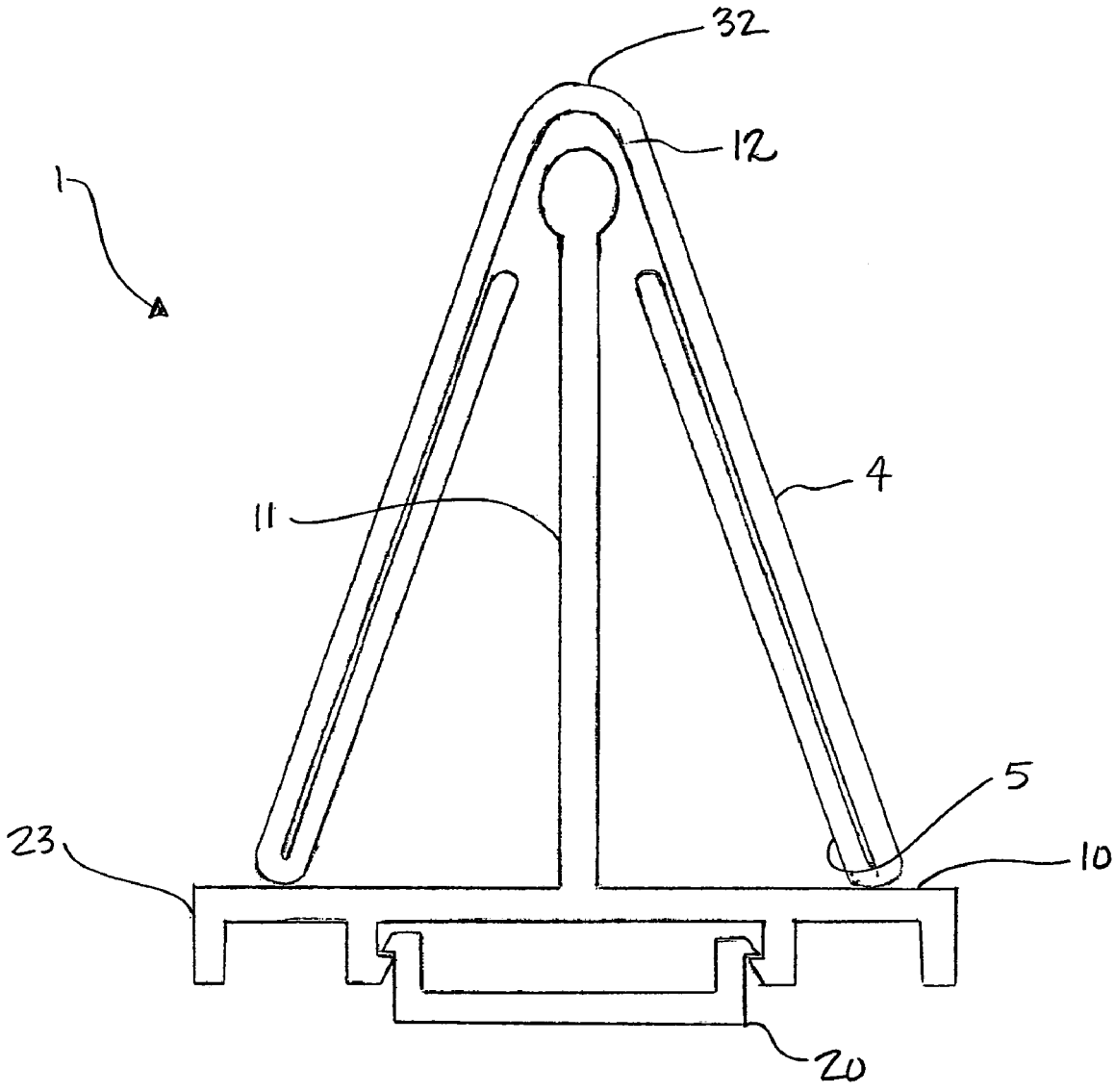
FIG. 4 is an end view of the checkout divider rail according to FIG. 2*a* shown supporting an embodiment of a checkout divider, having an open bottom.

As shown in FIG. 4, the longitudinal support wall 11 extends upwardly into the open bottom 5 of the checkout divider 4. The checkout divider 4 is supported on the rail base 10. The longitudinal wall 11 prevents the divider 4 from being dislodged from the rail 1. The thickened upper edge 12 of the support wall 11, is typically shaped to engage a top 32 of the divider 4, particularly a triangularly shaped divider 4.

Figure 5:
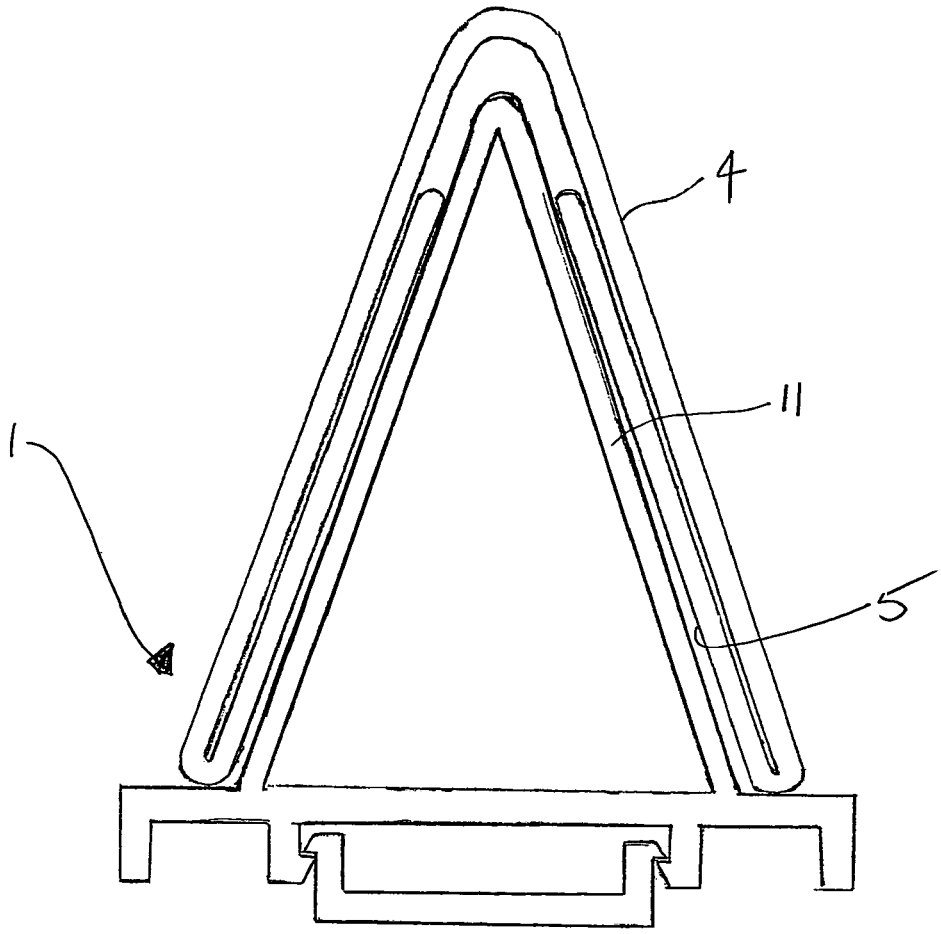
FIG. 5 is an end view of an alternate embodiment of the checkout divider rail according to FIG. 4, the second portion being shaped to conform to a shape of the open bottom of the checkout divider.

In another embodiment of the invention, as shown in FIG. 5, the longitudinal support wall 11 may be formed to mimic the shape of the open bottom 5 of the divider 4. The shaped support wall 11 acts to more securely support the divider 4 on the rail 1. In the embodiment shown in FIG. 5, the shape is triangular to correspond to the triangular shape of the divider's open bottom 5.

Figure 6B:
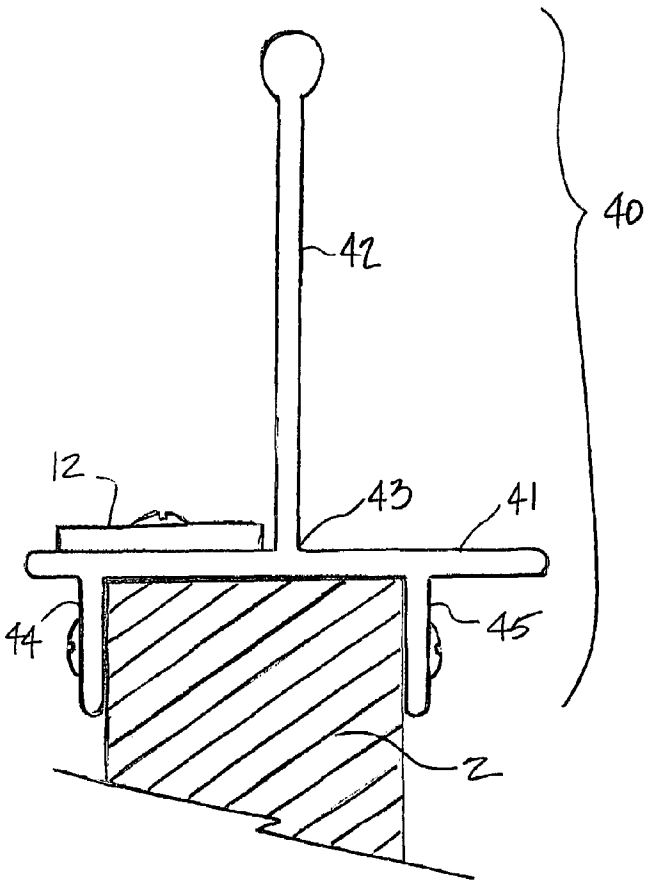
FIG. 6*b* is an end view according to FIG. 6*a* illustrating the checkout divider rail installed on the conveyor side wall and having a stop attached to prevent the divider from leaving the rail when supported and slid therealong.
Figure 6A:
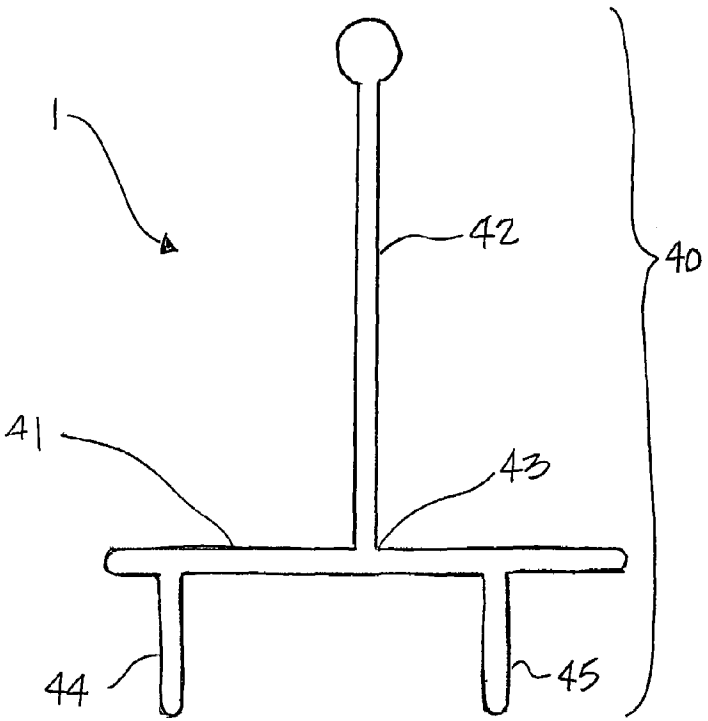
FIG. 6*a* is an end view of another embodiment of the checkout divider rail, the rail being a unitary rail having an offset open base for accepting a conveyor side wall therein and for positioning the divider towards the conveyor.

Having reference to FIGS. 6*a* and 6*b*, the rail 1 is a unitary rail element 40 having a base portion 41 and a longitudinal support wall portion 42, extending upwardly from the base portion 41 at a center 43 of the base portion 41.

With reference again to FIGS. 6*a* and 6*b*, and in another embodiment of the invention, the base portion 41 has a pair of downwardly depending members 44, 45 which are spaced so as to straddle the conveyors side wall 2. Optionally, the downwardly depending members 44, 45 are offset from the center 43 of the base portion 41 so as to position the longitudinal support wall 42 towards the conveyor 3. Thus, in cases where little space is available between the side wall 2 and the cash register, light standard or product racks (not shown), the rail 1 can still be affixed to the conveyor's side wall 2.

Figure 7:
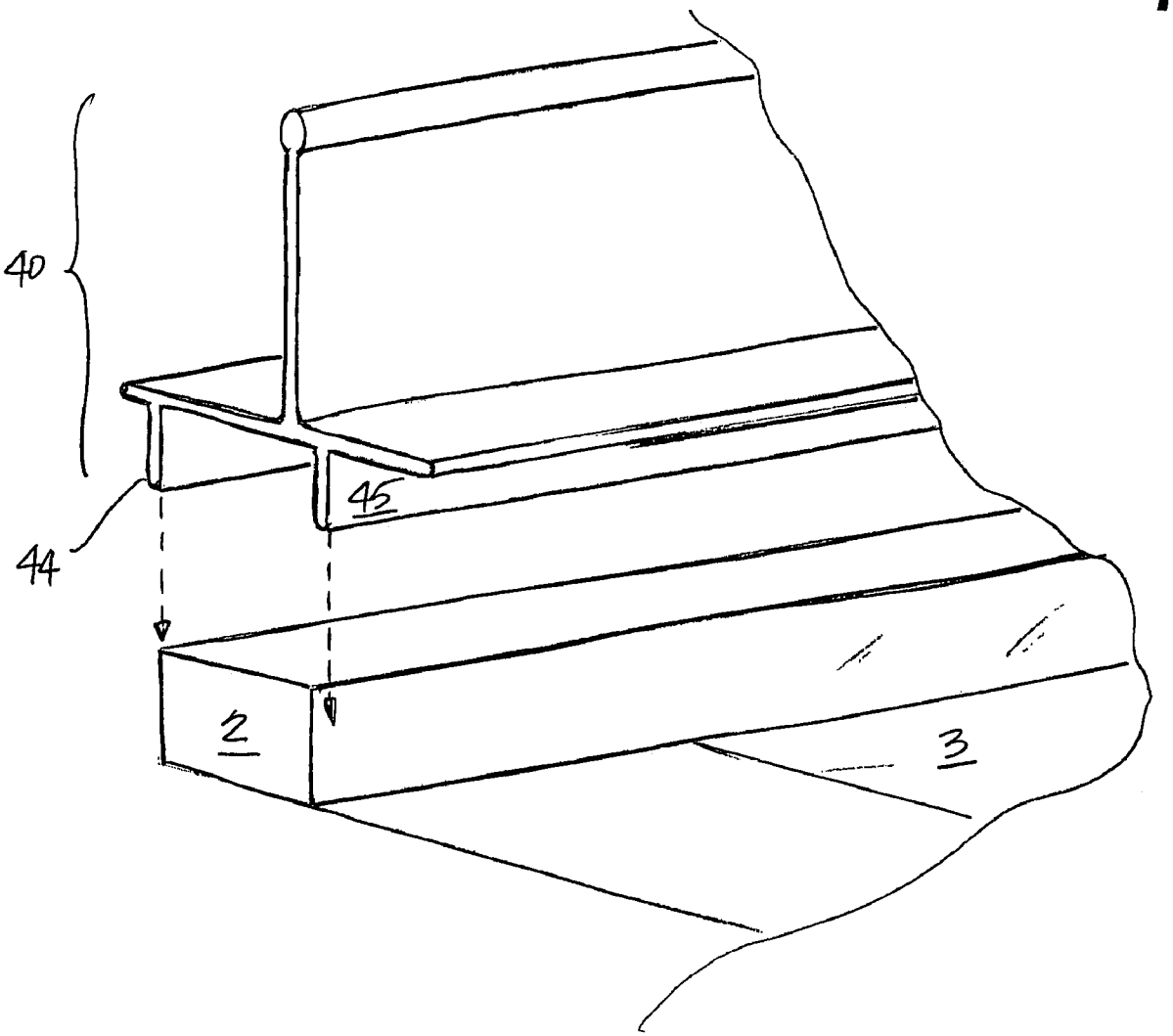
FIG. 7 is a perspective view according to FIGS. 6*a* and 6*b;*

As shown in FIG. 7, the unitary rail element 40 is positioned having the downwardly depending members 44, 45 straddling the conveyor's side wall 2. Typically, the unitary rail member is fastened to the side rail 2, along the side wall's length using fasteners, such as screws (not shown).

Figure 8B:
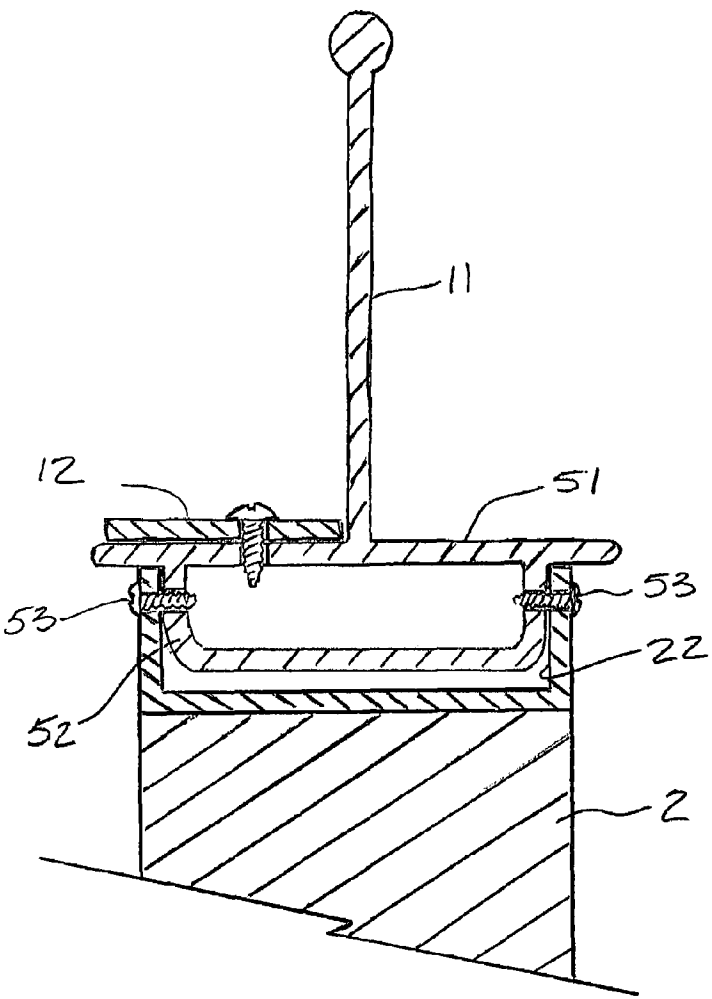
FIG. 8*b* is an end view according to FIG. 8*a*, illustrating the checkout divider rail fit within the existing channel on the conveyor side wall.
Figure 8A:
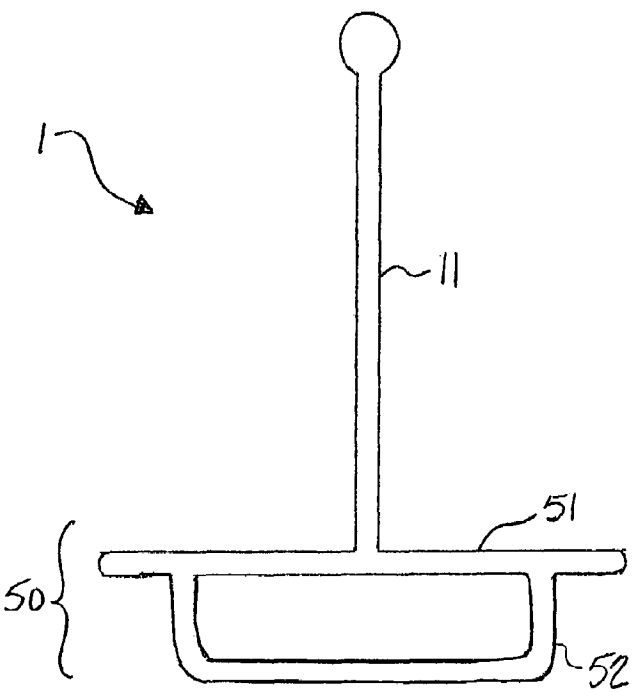
FIG. 8*a* is an end view of another embodiment of the checkout divider rail having a unitary closed base adapted for fitting within an existing channel mounted on a conveyor side wall.

Having reference to FIGS. 8*a* and 8*b* and in another embodiment of the invention, the rail 1 is formed having a shaped base 50 which is fit within an existing channel 22 on the conveyor's side wall 2. The shaped base 50 comprises a platform 51 for supporting the divider 4 and from which the longitudinal support wall 11 extends and an insert 52 which extends downwardly from the platform 51. The insert 52 is shaped so as to fit within the channel 22, where it is secured using fasteners, such as screws 53.

The embodiments of the invention in which an exclusive property or priviledge is claimed are described as follows:

1. A rail in combination with a checkout divider, the combination comprising:

a divider for separating items at a checkout comprising a longitudinal body having an open bottom and open ends;

a rail comprising a longitudinal base adapted for slideably supporting at least a portion of the checkout divider thereon and a longitudinal support wall extending substantially perpendicular from the longitudinal base and adapted for extending upwardly into the divider's open bottom for maintaining the divider in a substantially upright position thereon; and a stop at a distal end of the rail for engaging the divider for preventing the divider from sliding beyond the distal end of the rail.

2. The combination of claim 1 wherein the rail further comprises a thickened upper edge of the longitudinal support wall for providing additional support for the divider to minimize lateral movement of the divider therefrom.

3. The combination of claim 1 wherein the rail further comprises:

a first mating portion adapted to be affixed to a surface; and a corresponding second mating portion formed on the longitudinal base for engaging the first mating portion for affixing the longitudinal base to the first portion.

4. The combination of claim 3 wherein the first mating portion comprises upwardly extending catches formed therealong; and the second mating portion on the longitudinal base comprises downwardly depending catches formed along the longitudinal base for engaging the upwardly extending catches of the first portion.

5. The combination of claim 1 wherein the longitudinal support wall is shaped to mimic a shape of the divider's open bottom.

6. The combination of claim 5 wherein the longitudinal support wall is triangular in shape.

7. The combination of claim 1 wherein the longitudinal base and the longitudinal support wall are unitary.

8. The combination of claim 1 wherein the rail further comprising a pair of downwardly depending members extending from the longitudinal base, spaced apart and adapted to straddle a surface for affixing the rail thereto.

9. The combination of claim 8 wherein the downwardly depending members of the rail are offset from a center of the base adapted for positioning the support wall offset relative to the surface.

10. The combination of claim 8 wherein the downwardly depending members of the rail are adapted to be affixed to the surface using fasteners.

11. The combination of claim 1 wherein the longitudinal base of the rail is formed having a downwardly-depending, shaped insert adapted for insertion into a channel in a surface for affixing the longitudinal base thereto.

12. The combination of claim 7 wherein the rail further comprises a pair of downwardly depending members extending from the longitudinal base, spaced apart and adapted to straddle a surface for affixing the rail thereto.

13. The combination of claim 12 wherein the downwardly depending members of the rail are offset from a center of the base adapted for positioning the support wall offset relative to the surface.

14. The combination of claim 12 wherein the downwardly depending members of the rail are adapted to be affixed to the surface using fasteners.

15. The combination of claim 7 wherein the longitudinal base of the rail is formed having a downwardly-depending, shaped insert adapted for insertion into a channel in a surface for affixing the longitudinal base thereto.

16. A rail in combination with a checkout divider, the combination comprising:

a divider for separating items at a checkout comprising a longitudinal body having an open bottom and open ends; and a rail comprising a longitudinal base adapted for slideably supporting at least a portion of the checkout divider thereon and a longitudinal support wall extending substantially perpendicular from the longitudinal base and adapted for extending upwardly into the divider's open bottom for maintaining the divider in a substantially upright position thereon, wherein the rail further comprises a thickened upper edge of the longitudinal support wall for providing additional support for the divider to minimize lateral movement of the divider therefrom.

17. The combination of claim 16 wherein the longitudinal support wall is shaped to mimic a shape of the divider's open bottom.

18. The combination of claim 17 wherein the longitudinal support wall is triangular in shape.

19. The combination of claim 16 wherein the longitudinal base and the longitudinal support wall are unitary.

20. The combination of claim 16 wherein the rail further comprising a pair of downwardly depending members extending from the longitudinal base, spaced apart and adapted to straddle a surface for affixing the rail thereto.

21. The combination of claim 20 wherein the downwardly depending members of the rail are offset from a center of the base adapted for positioning the support wall offset relative to the surface.

22. The combination of claim 20 wherein the downwardly depending members of the rail are adapted to be affixed to the surface using fasteners.

23. The combination of claim 16 wherein the longitudinal base of the rail is formed having a downwardly-depending, shaped insert adapted for insertion into a channel in a surface for affixing the longitudinal base thereto.

24. The combination of claim 19 wherein the rail further comprises a pair of downwardly depending members extending from the longitudinal base, spaced apart and adapted to straddle a surface for affixing the rail thereto.

25. The combination of claim 24 wherein the downwardly depending members of the rail are offset from a center of the base adapted for positioning the support wall offset relative to the surface.

26. The combination of claim 24 wherein the downwardly depending members of the rail are adapted to be affixed to the surface using fasteners.

27. The combination of claim 19 wherein the longitudinal base of the rail is formed having a downwardly-depending shaped insert adapted for insertion into a channel in a surface for affixing the longitudinal base thereto.

* * * * *